US005576604A

United States Patent [19]

Kunert et al.

[11] Patent Number: 5,576,604

[45] Date of Patent: Nov. 19, 1996

[54] LINEAR MOTOR DRIVEN TRANSFER SWITCH ASSEMBLY

[75] Inventors: Armin Kunert, Pointe-Claire; Bruno Goupil, Beaconsfield, both of Canada

[73] Assignee: Tornatech Inc., Montreal, Canada

[21] Appl. No.: 404,801

[22] Filed: Mar. 15, 1995

[30] Foreign Application Priority Data

Jul. 29, 1994 [CA] Canada ..... 2129177

[51] Int. Cl.[6] ..... H01H 33/66

[52] U.S. Cl. ..... 318/135; 318/468; 318/687; 200/427; 200/410

[58] Field of Search ..... 318/468, 466, 318/467, 686, 687, 135; 307/64, 80; 200/48 A, 153 K, 18, 244, 144 R, 410, 426, 427, 329, 327

[56] References Cited

U.S. PATENT DOCUMENTS

| | | | |
|---|---|---|---|
| 3,688,228 | 8/1972 | Palmer et al. | 335/68 |
| 3,697,709 | 10/1972 | Wiktor | 200/48 |
| 3,764,761 | 10/1973 | Poltorak et al. | 200/76 |
| 3,796,937 | 3/1974 | Loffler et al. | 318/468 |
| 3,811,022 | 5/1974 | Guidosh | 200/144 B |
| 4,024,366 | 5/1977 | Hartwig | 200/153 |
| 4,168,407 | 9/1979 | Wiktor | 200/18 |
| 4,295,054 | 10/1981 | Kovatch et al. | 307/80 |
| 4,423,336 | 12/1983 | Iverson et al. | 307/64 |
| 4,760,278 | 7/1988 | Thomson | 307/64 |
| 4,791,255 | 12/1988 | Eliezer | 200/144 |
| 4,804,933 | 2/1989 | Becker et al. | 335/186 |
| 5,070,252 | 12/1991 | Castenschiold et al. | 307/64 |

*Primary Examiner*—John W. Cabeca
*Attorney, Agent, or Firm*—Quarles & Brady

[57] ABSTRACT

A transfer switch assembly to alternatively connect an electrical load to a primary or to a secondary power source. The transfer switch uses two conventional switches, or circuit breakers, having pivot type or linear type actuating members. A conventional linear motor is used. The actuating members of the switches, or circuit breakers, are in contact with the movable portion of the linear motor through a coupling mecanism. The coupling mecanism ensures that the switches, or circuit breakers, are not in a closed position simultaneously.

18 Claims, 3 Drawing Sheets

LINEAR MOTOR DRIVEN TRANSFER SWITCH ASSEMBLY

FIELD OF THE INVENTION

The present invention relates to transfer switches assemblies. More particularly, the invention relates to a transfer switch assembly, alternatively connecting an electrical load to a primary or to a secondary power source, including two conventional switching devices actuated by a linear motor.

BACKGROUND OF THE INVENTION

Transfer switches assemblies have been used for years in locations where it is necessary to use a secondary power source so that an electrical load may be automatically transferred to this source when a primary power source fails.

An important requirement of any transfer switch assembly is to prevent the simultaneous connection of the electrical load to the primary and to the secondary power source. To prevent this from occurring, the power source connected to the electrical load must always be disconnected before it is reconnected to the other power source. This requirement often leads to complex arrangements of mechanical components to move the actuating members of the switching mechanisms connecting the electrical load to the power sources.

In many known transfer switches assemblies, an electrical motor is used to move the actuating members of the switching mechanism from an opened to a closed position, or vice-versa. These motors often need gears and speed reducing devices to slow down the transitions. Furthermore, if an electrical motor is used, a motion limiting system is necessary to prevent overshooting.

Other transfer switches assemblies use a solenoid to move the actuating members of the switching mechanism from an opened to a closed position, or vice-versa. The major drawback of using a solenoid is the high speed of transition between the disconnection of the electrical load from one power source and the subsequent connection of the electrical load to the other power source. Indeed, repeated fast transitions may prematurely wear the moving parts of the transfer switch assembly, especially the switching devices. Furthermore, if the electrical load is of the type that regenerate electricity immediately subsequent to disconnection from one power source, the regenerated electricity may be discharged in the other power source, possibly causing problems.

Another drawback of the known transfer switches assemblies is their size. In many applications, transfer switches are installed in enclosures having small volumes, for example in pump controllers where a transfer switch assembly selects, from the electric network or an emergency electric generator, the power source supplying electricity to the pump.

OBJECTS OF THE INVENTION

An object of the present invention is therefore to overcome the above discussed drawbacks of conventional transfer switches assemblies.

Another object of the invention is to provide a transfer switch assembly using a linear electrical motor to move the actuating members of the switching mechanisms.

Another object of the invention is to provide a transfer switch assembly using pivot type switches or circuit breakers, actuated by a linear electrical motor, to connect an electrical load to a primary or to a secondary power source.

Another object of the invention is to provide a transfer switch assembly using toggle type switches or circuit breakers, actuated by a linear electrical motor, to connect an electrical load to a primary or to a secondary power source.

SUMMARY OF THE INVENTION

More specifically, in accordance with the present invention, there is provided a transfer switch assembly for alternatively connecting an electrical load to a primary electrical power source or to a secondary electrical power source. The transfer switch assembly comprises:

first electrical switching means for connection between the electrical load and the primary electrical power source, the first electrical switching means including a first actuating member movable (a) from an opened to a closed position or (b) from a closed to an opened position;

second electrical switching means for connection between the electrical load and the secondary electrical power source, the second electrical switching device including a second actuating member movable (a) from an opened to a closed position, or (b) from a closed to an opened position;

coupling means mechanically joining the first and second electrical actuating member;

an electrical linear motor having a fixed portion and a linearly movable portion, the linearly movable portion being associated with the coupling means to impart a linear motion to the coupling means (a) in a first direction to bring one of the first and second actuating members from a closed to an opened position, and subsequently bring the other of the first and second actuating members from an opened to a closed position, or (b) in a second direction to bring the other of the first and second actuating members from a closed to an opened position, and subsequently bring one of the first and second actuating members from an opened to a closed position, to thereby cause a connection of the electrical load to change from one of the primary electrical power source and the secondary electrical power source to the other of the primary electrical power source and the secondary electrical power source.

In the present disclosure and in the appended claims, (a) the expression "closed position" is intended to define a position where a connection of an electrical circuit is established, and (b) the expression "opened position" is intended to define a position where a connection of an electrical circuit is not established.

In one preferred embodiment of the invention, the first and second actuating members are pivotally movable from (a) an opened to a closed position, or (b) a closed to an opened position.

In another preferred embodiment of the invention, the first and second actuating members are linearly movable from (a) an opened to a closed position, or (b) a closed to an opened position and the first electrical switching means is disposed in an upside down relationship with respect to the second electrical switching means.

The objects, advantages and other features of the present invention will become more apparent upon reading of the following non restrictive description of preferred embodiments thereof, given by way of examples only with reference to the accompanying drawings.

DESCRIPTION OF PREFERRED EMBODIMENTS

Figure 1:
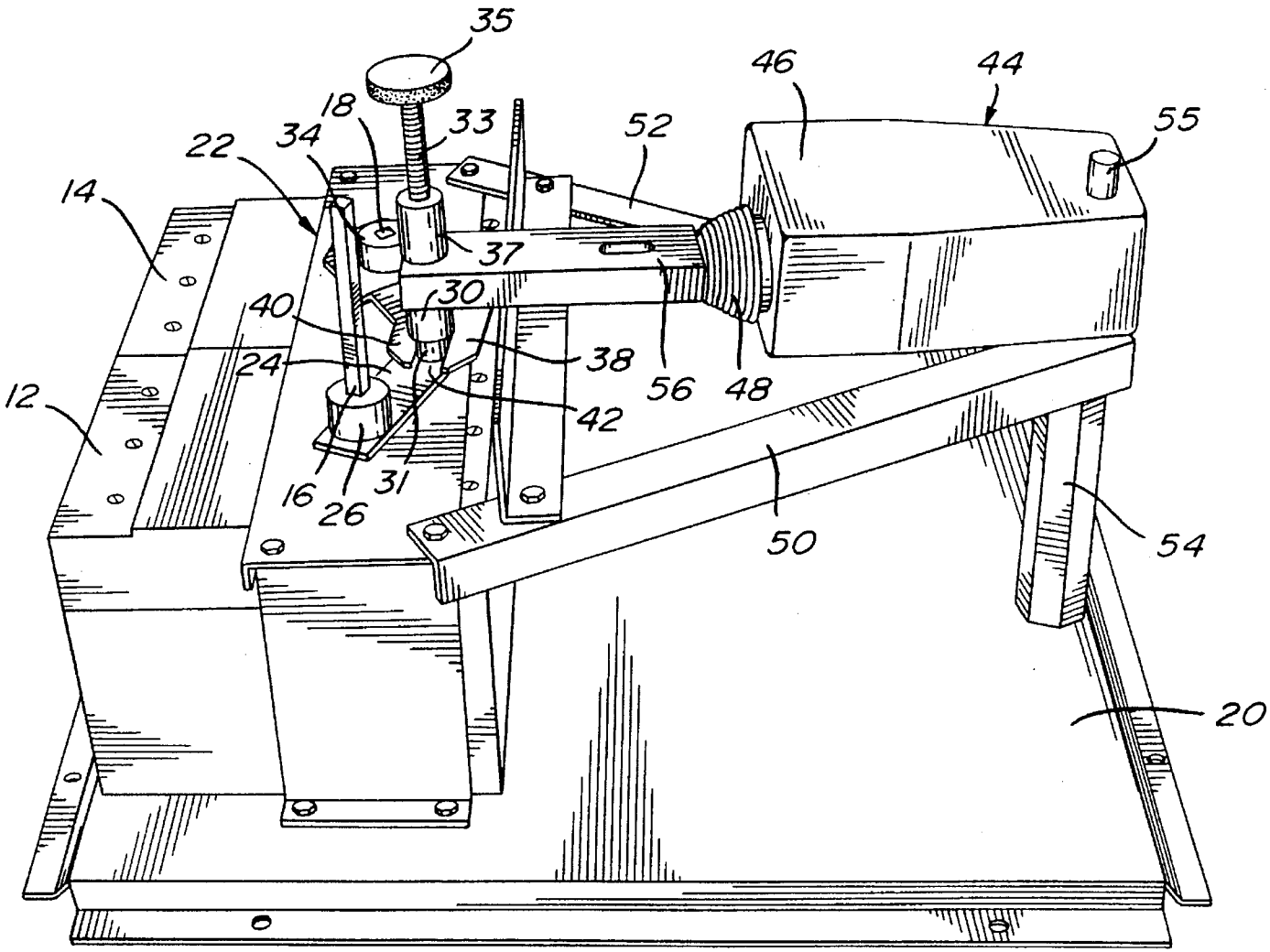
FIG. 1 is a perspective view of a first embodiment of a transfer switch assembly of the present invention using pivot type switches or circuit breakers.
Figure 2:
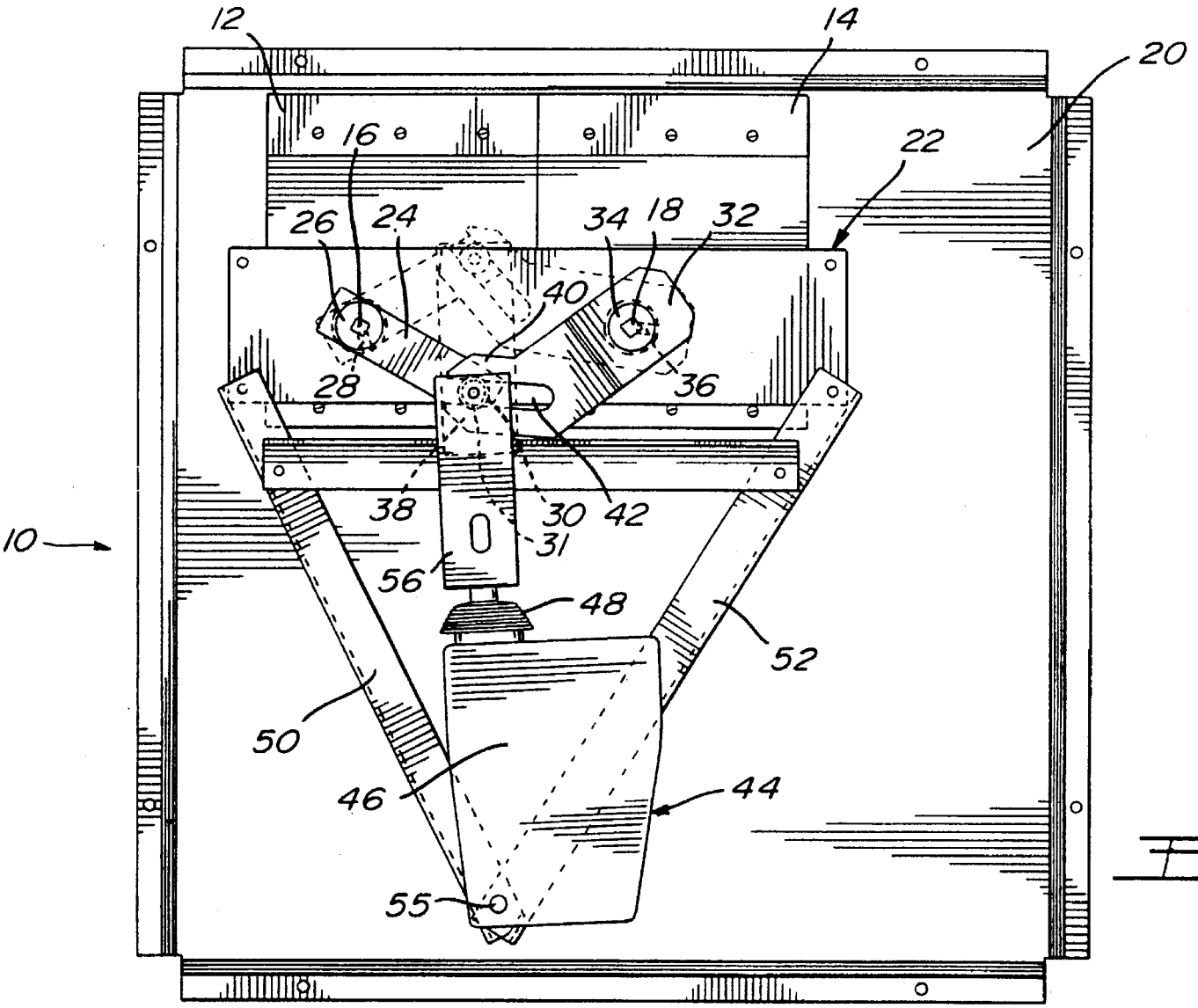
FIG. 2 is a top plan view of the embodiment of FIG. 1.

Referring to FIGS. 1 and 2, a first embodiment of a transfer switch assembly 10 made in accordance with the present invention will be described. The transfer switch assembly 10 is designed to be used in association with two conventional pivot type switching devices 12 and 14.

Switching devices 12 and 14 include shafts 16 and 18, respectively, which, when actuated, serve to select between an opened position and a closed position.

The switching devices 12 and 14 are mounted side-by-side on a mounting plate 20 and are maintained in proper position by a support 22, fastened to mounting plate 20 that includes two apertures to allow shafts 16 and 18 to protrude therethrough.

The switching devices 12 and 14 also include terminals (not shown) to which are attached an electrical load (not shown), a primary power source (not shown) and a secondary power source (not shown).

For the simplification of the description of the transfer switch assembly 10, it will be assumed that switching device 12 alternatively provides an electrical connection between the secondary power source and the electrical load and that switching device 14 alternatively provides an electrical connection between the primary power source and the electrical load.

A lever 24 is attached to the shaft 16 by means of a collar 26; this collar is mounted at a first end of lever 24 and includes a set screw 28 to maintain the lever 24 in a predetermined position. The opposite end of lever 24 includes a pivot pin 30 substantially parallel to shaft 16. Pivot pin 30 includes a roller bearing 31.

A second lever 32 is attached to the shaft 18 by means of a collar 34; this collar is mounted at a first end of lever 32 and includes a set screw 36 to maintain the lever 32 in a predetermined position. The opposite end of lever 32 is forked, including two prongs 38 and 40 defining a slot 42. The prongs 38 and 40 engage roller bearing 31 and the width of slot 42 is sufficient to allow roller bearing 31 to easily roll therein and thus reduce friction.

Transfer switch assembly 10 also includes a conventional linear motor 44 having a fixed portion 46 and a linearly movable portion 48.

The fixed portion 46 is maintained in position by two support brackets 50 and 52, fastened to the support 22, and by a post 54 erected between mounting plate 20 and the fixed portion 46 of motor 44. Post 54 includes a cylindrical extension 55 going through apertures (not shown) in brackets 50 and 52 and going through an aperture in the fixed portion 46 of linear motor 44. A fastening device (not shown) may be used to prevent the fixed portion 46 of linear motor 44 to disengage from extension 55. The extension 55 being cylindrical, the fixed portion 46 may rotate about extension 55. This rotation will occur when the movable portion 48 moves.

A connecting member 56 ensures the link between the pivot pin 30 and the linearly movable portion 48 of linear motor 44. A shoulder screw 33 including a knob 35 is screwed through a cylindrical spacer 37, connecting member 56 and finally pivot pin 30, thereby securing the connecting member 56 to the pivot pin 30 (see FIG. 1). The function of cylindrical spacer 37 will be explained later.

As easily understood by persons of ordinary skill in the art, conventional switches or circuit breakers having a shaft to select, by rotation, between opened and closed positions may be used as switching devices 12 and 14.

It is to be noted that the ratings in voltage or current of the switching devices 12 and 14 may be easily selected according to the particular electrical load to be driven by the transfer switch assembly since conventional off-the-shelf switches or circuit breakers are used.

Having described the various components forming the invention, attention will now be given to the operation of the transfer switch assembly 10.

FIG. 2 illustrates, in solid lines, the transfer switch assembly 10 in a position where the switching device 12 is in an opened position and the switching device 14 is in a closed position. The electrical load is supplied by the primary power source. When the transfer switch assembly 10 is in this position, the linearly movable portion 48 of motor 44 is fully retracted.

It is to be noted that the angular position of lever 32 on shaft 18 is important. Indeed, to ensure that switching device 14 changes from a closed position to an opened position before switching device 12 changes from an opened position to a closed position, lever 32 is angularly positioned on shaft 18 so that a small clockwise angular motion of lever 32 with respect to the position of lever 32 illustrated in full lines in FIG. 2, causes a transition from a closed position to an opened position of switching device 14.

If the voltage of the primary power source falls below a predetermined level, a motor controller (not shown) energizes the linear motor 44. The linearly movable portion 48 is then extended, lever 24 is rotated counterclockwise and lever 32 is rotated clockwise.

During the displacement of the movable portion 48 of linear motor 44 from a fully retracted position to a fully extended position, three successive different phases will be encountered. Firstly, for only a small fraction of the distance travelled by the movable portion 48 of linear motor 44, the switching device 14 is in a closed position and switching device 12 is in an opened position. Secondly, for the major part of the distance travelled by the movable portion 48 of linear motor 44, both switching devices 12 and 14 are in an opened position. Finally, for the last small fraction of the distance travelled by the movable portion 48 of linear motor 44, the switching device 12 is in a closed position and switching device 14 is in an opened position.

FIG. 2 also illustrates, in dotted lines, the position of the levers 24 and 32 and the connecting member 56 when the switching device 12 is in a closed position and the switching device 14 is in an opened position. The electrical load is supplied by the secondary power source. When the transfer switch assembly 10 is in this position, the linearly movable portion 48 of motor 44 is fully extended.

It is to be noted at this point that the angular position of lever 24 on shaft 16 is important. Indeed, to ensure that switching device 12 changes from a closed position to an opened position before switching device 14 changes from an opened position to a closed position, lever 24 is angularly positioned on shaft 16 so that a small clockwise angular motion of lever 24, with respect to the position of lever 24 illustrated in dotted lines in FIG. 2, causes a transition from a closed position to an opened position of switching device 12.

If the voltage of the primary power source returns above a predetermined level, a motor controller (not shown) energizes the linear motor 44. The linearly movable portion 48 is then retracted, lever 24 is rotated clockwise and lever 32 is rotated counterclockwise.

During the displacement of the movable portion 48 of linear motor 44 from a fully extended position to a fully retracted position, three successive different phases will be encountered. Firstly, for only a small fraction of the distance travelled by the movable portion 48 of linear motor 44, the switching device 12 is in a closed position and switching device 14 is in an opened position. Secondly, for the major part of the distance travelled by the movable portion 48 of linear motor 44, both switching devices 12 and 14 are in an opened position. Finally, for the last small fraction of the distance travelled by the movable portion 48 of linear motor 44, the switching device 14 is in a closed position and switching device 12 is in an opened position.

As will be understood by persons of ordinary skills in the art, the second phase of the displacement of the movable portion 48 of linear motor 44 in either direction is sufficiently long to prevent simultaneous connection of the electrical load to both power sources.

It is to be noted that it is possible to manually operate the transfer switch 10. To do so, shoulder screw 33 including knob 35 is unfastened from pivot pin 30. The connecting piece 56 is no longer connected to pivot pin 30, thus the protruding end of shaft 16 can be rotated to transfer the electrical load from one power source to the other power source or to disconnect the load from both power source. It is also to be noted that a limit switch (not shown), located on connecting member 56 and actuated by cylindrical spacer 37, is used to disconnect the linear motor 44 from the motor controller (not shown) when the connecting piece 56 is not connected to the pivot pin 30.

It is also to be noted that slot 42 formed on lever 32 could be replaced by another system allowing the levers to rotate simultaneously in opposite directions.

Figure 3:
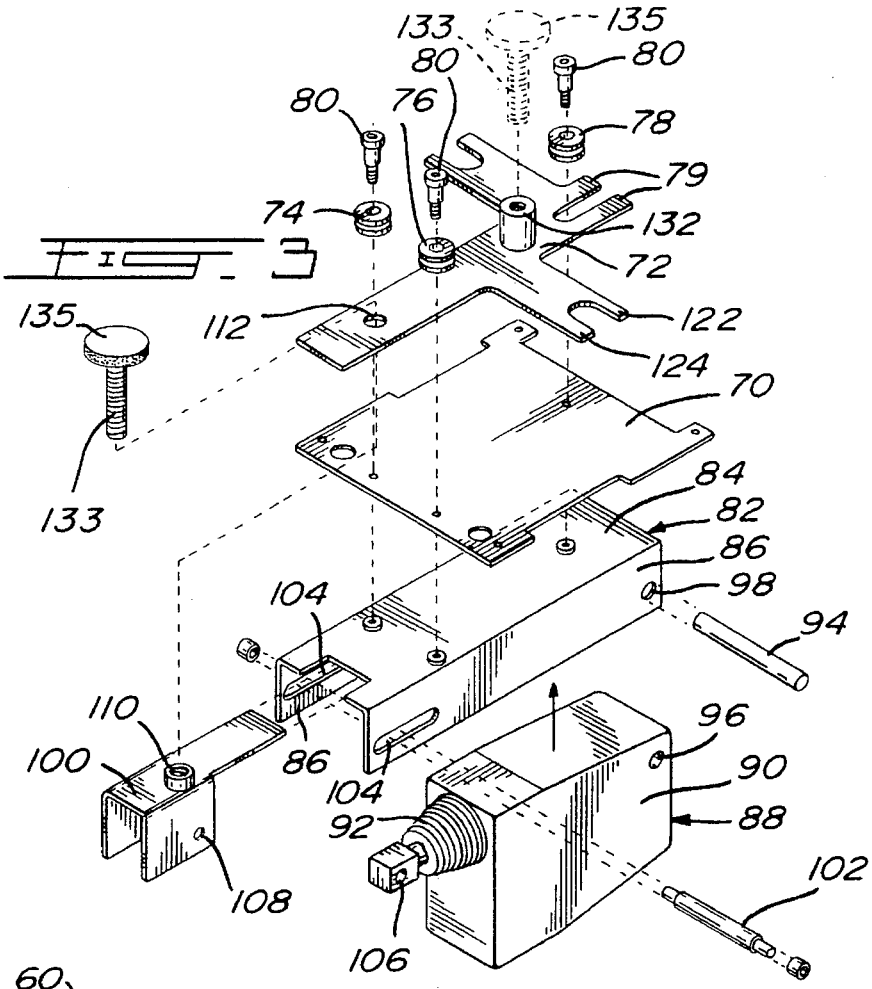
FIG. 3 is an exploded perspective view of a second embodiment of a transfer switch assembly of the present invention using toggle type switches or circuit breakers.
Figure 4:
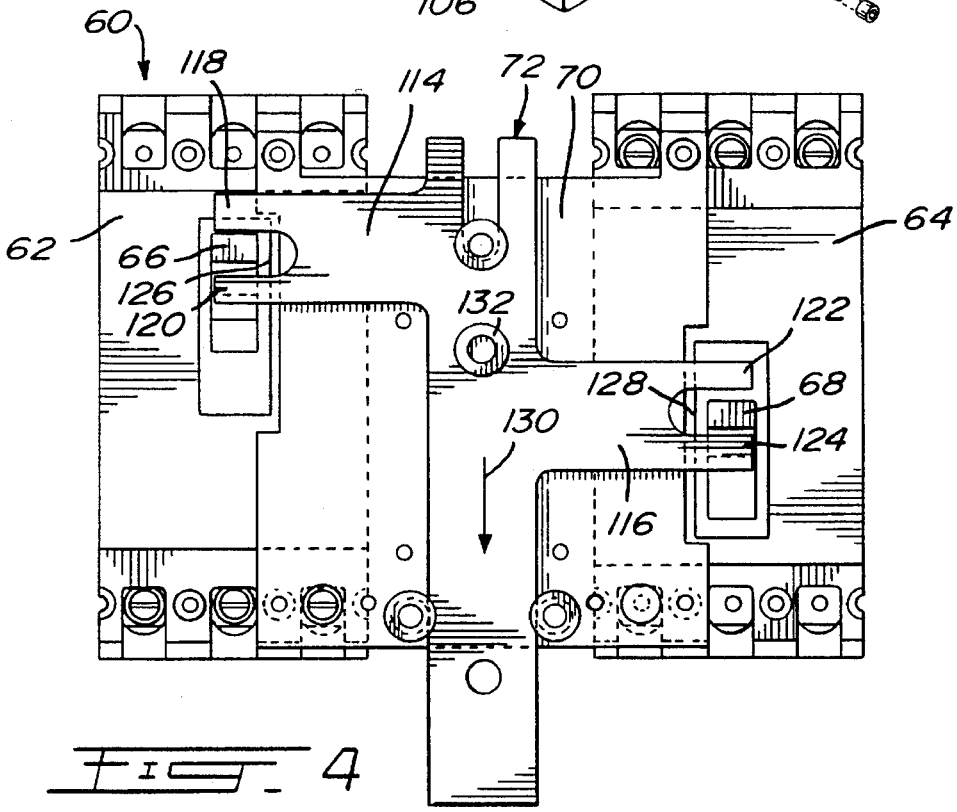
FIG. 4 is a top plan view of the embodiment of FIG. 3.

Referring to FIGS. 3 and 4, a second embodiment 60 of the present invention, designed to be used in association with two conventional toggle type switching devices 62 and 64, is illustrated.

Switching devices 62 and 64 include respective projecting levers 66 and 68 to select between an opened position and a closed position of the switching devices 62 and 64.

The switching devices 62 and 64 are maintained spaced apart from each other by and fastened to a mounting support 70. Switching device 64 is fastened to the mounting support 70 in an upside down position with respect to switching device 62, as illustrated in FIG. 4.

The switching devices 62 and 64 also include terminals (not shown) to which are attached an electrical load (not shown), a primary power source (not shown) and a secondary power source (not shown). For the simplification of the description of the transfer switch assembly 60, it will be assumed that switching device 62 alternatively provides an electrical connection between the primary power source and the electrical load and that switching device 64 alternatively provides an electrical connection between the secondary power source and the electrical load. It will also be evident upon reading of the disclosure herein that FIG. 4 illustrates the switching device 62 is in a closed position and that the switching device 64 is in an opened position.

A T-shaped coupling 72 is slidably mounted between two grooved rollers 74 and 76. A third grooved roller 78 is installed between two prongs 79 formed at one end of the T-shaped coupling 72.

Fasteners 80 are used to attach the three grooved rollers 74, 76 and 78 to the mounting support 70. The fasteners 80 extend through mounting support 70 to be secured to a motor mounting bracket 82.

The motor bracket 82 has an inverted U-shaped profile defined by a top flange 84 and a pair of side webs 86. A linear motor 88, including a fixed portion 90 and a linearly movable portion 92, is maintained between the side webs 86 by a fastener 94 inserted into corresponding apertures 96 and 98 of fixed portion 90 and side webs 86, respectively. The linearly movable portion 92 of motor 88 is connected to a movable bracket 100 through a fastener 102 inserted into slots 104 of motor bracket 82, aperture 106 of the linearly movable portion 92 and into apertures 108 of movable bracket 100.

A shoulder screw 133 including a knob 135 is inserted through aperture 112 of the T-shaped bracket and is fastened to a threaded aperture 110 of movable bracket 100, thus motion of the linearly movable portion 92 of motor 88 imparts motion to the T-shaped coupling 72. When the shoulder screw 133 is secured to the movable bracket 100, a limit switch (not shown) is in a closed position and the linear motor is electrically connected to a motor controller (not shown).

The sliding T-shaped coupling 72 includes two arms 114 and 116 terminating with pairs of prongs 118,120 and 122,124, respectively. Prongs 118,120 define a slot 126 sufficiently wide to allow projecting lever 66 to be mounted therein. Prongs 122, 124 define a slot 128 sufficiently wide to allow projecting lever 68 to be mounted therein.

As will be understood by persons of ordinary skills in the art, conventional toggle type switches or circuit breakers may be used as switching devices 62 and 64.

It is to be noted that the ratings in voltage or current of the switching devices 62 and 64 may be easily selected according to the particular load to be driven by the transfer switch assembly since conventional off-the-shelf switches or circuit breakers are used.

In operation, when the linearly movable portion 92 of linear motor 88 is in a retracted position, the T-shaped bracket is in the position illustrated in FIG. 4. In this position, actuating member 66 of switching device 62 is in a closed position and actuating member 68 of switching device 64 is in an opened position. The electrical load (not shown) is supplied by the primary power source (not shown).

If the voltage of the primary power source falls below a predetermined level, a motor controller (not shown) energizes the linear motor 88. The linearly movable portion 92 extends causing the T-shaped coupling 72 to move in the direction indicated by arrow 130.

Prong 118 will push actuating member 66 in the direction of arrow 130, while prong 122 reaches actuating member 68. Therefore, upon continuation of the motion of the T-shaped coupling 72, the actuating member 66 will be toggled to an opened position before actuating member 68 is toggled from an opened position to a closed position.

If the voltage of the primary power source returns above a predetermined level, the motor controller (not shown) energizes the linear motor 88. The linearly movable portion 92 retracts causing the T-shaped coupling 72 to move in the direction opposite to the direction indicated by arrow 130.

Prong 124 will push actuating member 68 in the direction of motion of coupling 72, while prong 120 reaches actuating member 66. Therefore, upon continuation of the motion of the T-shaped coupling 72, the actuating member 68 will be toggled to an opened position before actuating member 66 is toggled from an opened position to a closed position.

It is to be noted that it is possible to manually operate the transfer switch 60. To do so, shoulder screw 133 is unfastened from threaded aperture 110. The connecting piece T-shaped coupling 72 is no longer connected to the movable portion 92 of linear motor 90. The shoulder screw 133 may be screwed to threaded support 132 (see dotted lines on FIG. 3) to thereby provide for the manual movement of the T-shape bracket 72. It is then possible to transfer the electrical load from one power source to the other power source or to disconnect the load from both power source. It is also to be noted that motor 90 cannot be automatically activated since the shoulder screw 133 is removed from aperture 110; thus, the limit switch (not shown) is in an opened position and motor 90 is not electrically connected to a motor controller (not shown).

It is believed that it is within the reach of persons skilled in the art to calculate the width of slots 126 and 128 and of the disposition of the arms 114 and 116 to ensure that the actuating member, being in a closed position, is toggled before the actuating member, being in an opened position, to prevent simultaneous connection of the electrical load to both electrical power sources.

It is to be noted that, in both embodiments of the present invention, motion range limiting devices are not used since linear motors have a predetermined course length.

Although the present invention has been described hereinabove by way of preferred embodiments thereof, it can be modified, without departing from the spirit and nature of the subject invention as defined in the appended claims.

What is claimed is:

1. A transfer switch assembly for alternatively connecting an electrical load to a primary electrical power source and to a secondary electrical power source, said transfer switch comprising:

first electrical switching means for connection between the electrical load and the primary electrical power source, said first electrical switching means including a first rotatable actuating member that is movable between an opened position and a closed position;

second electrical switching means for connection between the electrical load and the secondary electrical power source, said second electrical switching means including a second rotatable actuating member that is movable between an opened position and a closed position;

an electrical linear motor having a fixed portion and a linearly movable portion;

coupling means mechanically joining said first and second rotatable actuating members to said linearly movable portion of said linear motor; said coupling means including first and second lever means having respective first and second ends, said first end of said first lever means being mounted to said first rotatable actuating member while said first end of said second lever means being mounted to said second rotatable actuating member; said coupling means also including a connecting means for connecting said second ends of said first and second lever means, said connecting means being also connected to said linearly movable portion of said linear motor;

wherein, (a) linear motion of said coupling means in a first direction brings one of said first and second rotatable actuating members from a closed position to an opened position, and subsequently brings the other of said first and second rotatable actuating members from an opened position to a closed position, and (b) linear motion of said coupling means in a second direction brings the other of said first and second rotatable actuating members from the closed position to the opened position, and subsequently bring one of said first and second rotatable actuating members from the opened position to the closed position, to thereby cause a connection of the electrical load to change from one of the primary electrical power source and the secondary electrical power source to the other of the primary electrical power source and the secondary electrical power source.

2. A transfer switch assembly as defined in claim 1, wherein:

said second end of said first lever means includes a pivot pin pivotally joining said second end of said first lever means and said connecting means; and said second end of said second lever means includes a slot engaging said pivot pin, said slot being disposed at an angle relative to a longitudinal axis extending through said second lever means, said slot having a width allowing relative motion of said pivot pin therein.

3. A transfer switch assembly as defined in claim 1, wherein said first and second electrical switching means are circuit breakers.

4. A transfer switch assembly as defined in claim 1, wherein said first and second electrical switching means are switches.

5. In combination with (i) a primary electrical power source, (ii) a secondary power source, (iii) an electrical load, (iv) a first electrical switching means for connection between the electrical load and the primary electrical power source, said first electrical switching means including a first rotatable actuating member that is movable between an opened position and a closed positions, and (v) a second electrical switching means for connection between the electrical load and the secondary electrical power source, said second electrical switching means including a second rotatable actuating member that is movable between an opened position and a closed position, for alternatively connecting an electrical load to one of the primary electrical power source and the secondary electrical power source, a transfer switch actuator comprising:

an electrical linear motor having a fixed portion and a linearly movable portion;

coupling means mechanically joining the first and second rotatable actuating members to said linearly movable portion of said linear motor; said coupling means including first and second lever means having respective first and second ends, said first end of said first lever means being mounted to said first rotatable actuating member while said first end of said second lever means being mounted to said second rotatable actuating member; said coupling means also including a connecting means for connecting said second ends of said first and second lever means, said connecting means being also connected to said linearly movable portion of said linear motor;

wherein (a) linear motion of said coupling means in a first direction brings one of said first and second rotatable actuating members from a closed to an opened position, and subsequently brings the other of said first and second rotatable actuating members from an opened to a closed position, and (b) linear motion of said coupling means in a second direction brings the other of said first and second rotatable actuating members from a closed to an opened position, and subsequently brings one of said first and second actuating members from an opened to a closed position, to thereby cause a connection of the electrical load to change from one of the primary electrical power source and the secondary electrical power source to the other of the primary electrical power source and the secondary electrical power source.

6. A transfer switch actuator as defined in claim 5, wherein:

said second end of said first lever means includes a pivot pin pivotally joining said second end of said first lever means and said connecting means; and said second end of said second lever means includes a slot engaging said pivot pin, said slot being disposed at an angle relative to a longitudinal axis extending through said second lever means, said slot having a width allowing relative motion of said pivot pin therein.

7. A transfer switch actuator as defined in claim 5, wherein said first and second electrical switching means are circuit breakers.

8. A transfer switch actuator as defined in claim 5, wherein said first and second electrical switching means are switches.

9. A transfer switch assembly for alternatively connecting an electrical load to a primary electrical power source and to a secondary electrical power source, said transfer switch comprising:

first electrical switching means for connection between the electrical load and the primary electrical power source, said first electrical switching means including a first toggle actuating member reciprocately movable between opened and closed positions;

second electrical switching means for connection between the electrical load and the secondary electrical power source, said second electrical switching means including a second toggle actuating member reciprocately movable between opened and closed positions; said second electrical switching means being disposed in an upside down relationship with respect to said first electrical switching means;

an electrical linear motor having a fixed portion and a linearly movable portion, coupling means mechanically joining said first and second toggle actuating members; said coupling means including a substantially T-shaped bracket having an elongated first end and a second end, said T-shaped bracket also including a first and second arm substantially perpendicular to a longitudinal axis extending through said bracket and having respective distal ends; said distal end of said first arm being connected to said first toggle actuating member and said distal end of said second arm being connected to said second toggle actuating member; said coupling means also including a connecting means for connecting said T-shaped bracket to said linearly movable portion of said linear motor;

wherein, (a) linear motion of said coupling means in a first direction brings one of said first and second toggle actuating members from a closed to an opened position, and subsequently brings the other of said first and second toggle actuating members from an opened to a closed position, and (b) linear motion of said coupling means in a second direction brings the other of said first and second toggle actuating members from a closed to an opened position, and subsequently brings said one of said first and second toggle actuating members from an opened to a closed position, to thereby cause a connection of the electrical load to change from one of the primary electrical power source and the secondary electrical power source to the other of the primary electrical power source and the secondary electrical power source.

10. A transfer switch assembly as defined in claim 9, wherein said first and second electrical switching means are circuit breakers.

11. A transfer switch assembly as defined in claim 9, wherein said first and second electrical switching means are switches.

12. A transfer switch assembly as defined in claim 9, wherein said second end of said T-shaped bracket is slotted, and wherein said first and second arms are terminated by a pair of prongs spaced apart from each other and defining a slot respectively engaging said first and second toggle actuating members.

13. A transfer switch assembly as defined in claim 12, wherein:

said slots being wider than said actuating members;

said arms of said T-shaped bracket are disposed so that if one of said first and second toggle actuating members is in a closed position the other of said first and second toggle actuating members is in an opened position and if said other of said first and second toggle actuating members is in a closed position said one of said first and second toggle actuating members is in an opened position;

said slots being disposed so that:

when the T-shaped bracket is linearly moved in said first or second direction by said linearly movable portion of said linear motor, a prong of the arm engaging the actuating member being in a closed position contacts said actuating member being in a closed position and toggles it in an opened position, and subsequently, a prong of the arm engaging the actuating member being in an opened position contacts said actuating member being in an opened position and toggles it in a closed position.

14. In combination with (i) a primary electrical power source, (ii) a secondary power source, (iii) an electrical load, (iv) a first electrical switching means for connection between the electrical load and the primary electrical power source, said first electrical switching means including a first toggle actuating member reciprocately movable between opened and closed positions, and (v) a second electrical switching means for connection between the electrical load and the secondary electrical power source, said second electrical switching means including a second toggle actuating member reciprocately movable between opened and closed positions, said second electrical switching means being disposed in an upside down relationship with respect to said first electrical switching means; for alternatively connecting an electrical load to the primary electrical power source and to the secondary electrical power source, a transfer switch actuator comprising:

an electrical linear motor having a fixed portion and a linearly movable portion;

coupling means mechanically joining the first and second toggle actuating members to said linearly movable portion of said linear motor; said coupling means including a substantially T-shaped bracket having an elongated first end and a second end, said T-shaped bracket also including a first and second arm substantially perpendicular to a longitudinal axis extending through said bracket and having respective distal ends; said distal end of said first arm being connected to said first toggle actuating member and said distal end of said second arm being connected to said second toggle actuating member; said coupling means also including a connecting means for connecting said T-shaped bracket to said linearly movable portion of said linear motor;

wherein (a) linear motion of said coupling means in a first direction brings one of said first and second toggle actuating members from a closed to an opened position, and subsequently brings the other of said first and second toggle actuating members from an opened to a closed position, and (b) linear motion of said coupling means in a second direction brings the other of said first and second toggle actuating members from a closed to an opened position, and subsequently brings one of said first and second actuating members from an opened to a closed position, to thereby cause a connection of the electrical load to change from one of the primary electrical power source and the secondary electrical power source to the other of the primary electrical power source and the secondary electrical power source.

15. A transfer switch actuator as defined in claim 14, wherein said first and second electrical switching means are circuit breakers.

16. A transfer switch actuator as defined in claim 14, wherein said first and second electrical switching means are switches.

17. A transfer switch actuator as defined in claim 14, wherein said second end of said T-shaped bracket is slotted, and wherein said first and second arms are terminated by a pair of prongs spaced apart from each other and defining a slot respectively engaging one of said first and second toggle actuating members.

18. A transfer switch actuator as defined in claim 17, wherein:

said slots being wider than said actuating members;

said arms of said T-shaped bracket are disposed so that if one of said first and second toggle actuating members is in a closed position another of said first and second toggle actuating members is in an opened position and if said other of said first and second toggle actuating members is in a closed position said one of said first and second toggle actuating members is in an opened position;

said slots being disposed so that:

when the T-shaped bracket is linearly moved in either one of said first direction and said second direction by said linearly movable portion of said linear motor, a prong of the arm engaging the toggle actuating member being in a closed position contacts said actuating member being in a closed position and toggle it in an opened position, and subsequently, a prong of the arm engaging the toggle actuating member being in an opened position contacts said actuating member being in an opened position and toggle it in a closed position.

* * * * *